US006092806A

United States Patent [19]

Follis

[11] Patent Number: 6,092,806

[45] Date of Patent: Jul. 25, 2000

[54] 100 POINT NCAA BASKETBALL TOURNAMENT GAME

[76] Inventor: Charles Follis, 1025 Schiele Ave., San Jose, Calif. 95126

[21] Appl. No.: 09/012,604

[22] Filed: Jan. 23, 1998

Related U.S. Application Data

[60] Provisional application No. 60/034,845, Jan. 27, 1997.

[51] Int. Cl.[7] ..... A63F 3/06; A63F 3/08

[52] U.S. Cl. ..... 273/138.1; 463/16; 463/42

[58] Field of Search ..... 273/138.2, 138.1; 463/16, 17, 42, 40

[56] References Cited

U.S. PATENT DOCUMENTS

| | | | |
|---|---|---|---|
| 4,252,321 | 2/1981 | Hopewood | 273/247 |
| 5,083,271 | 1/1992 | Thacher et al. | 364/411 |
| 5,163,687 | 11/1992 | Jenkins | 273/277 |
| 5,332,218 | 7/1994 | Lucey | 273/138.2 |

OTHER PUBLICATIONS

IGWB Feb. 1997, "The wide world of sport–betting", pg. 60.

IGWB Apr. 1997, Rewriting the book, pp. 45–49.

*Primary Examiner*—Benjamin H. Layno

*Attorney, Agent, or Firm*—Townsend and Townsend and Crew LLP

[57] ABSTRACT

A 100 point NCAA basketball tournament prediction game consisting of 4 primary elements: 1) A contestant entry form, 2) a scoring system with 100 points available overall to contestants, 3) data processing means for determining contestant game scores, and 4) means for notification of results to contestants. Contestant enter which teams they believe will prevail as vicorious in each of the NCAA tournaments 63 slots. 100 game points are available to the contestants. Point values for each of the tournaments 63 slot matchups are dependent on which of the 6 rounds of competition that the slot occurs. The overall point formula for correct predictions varies between rounds based on a mathematical function that is discontinuous in nature. Data processing equipment is utilized to calculate contestant game scores during and at the conclusion of the tournament. Contestants are ranked in terms of performance, and prizes are awarded to top performers. Top performers with equal scores may need to depend of implementation of a tie breaking formula based on game point predictions to distinguish exact overall placement. This game advocates but does not restrict itself to communication to and from contestants across the internet system.

7 Claims, 13 Drawing Sheets

CONTESTANT POINT SUMMARY
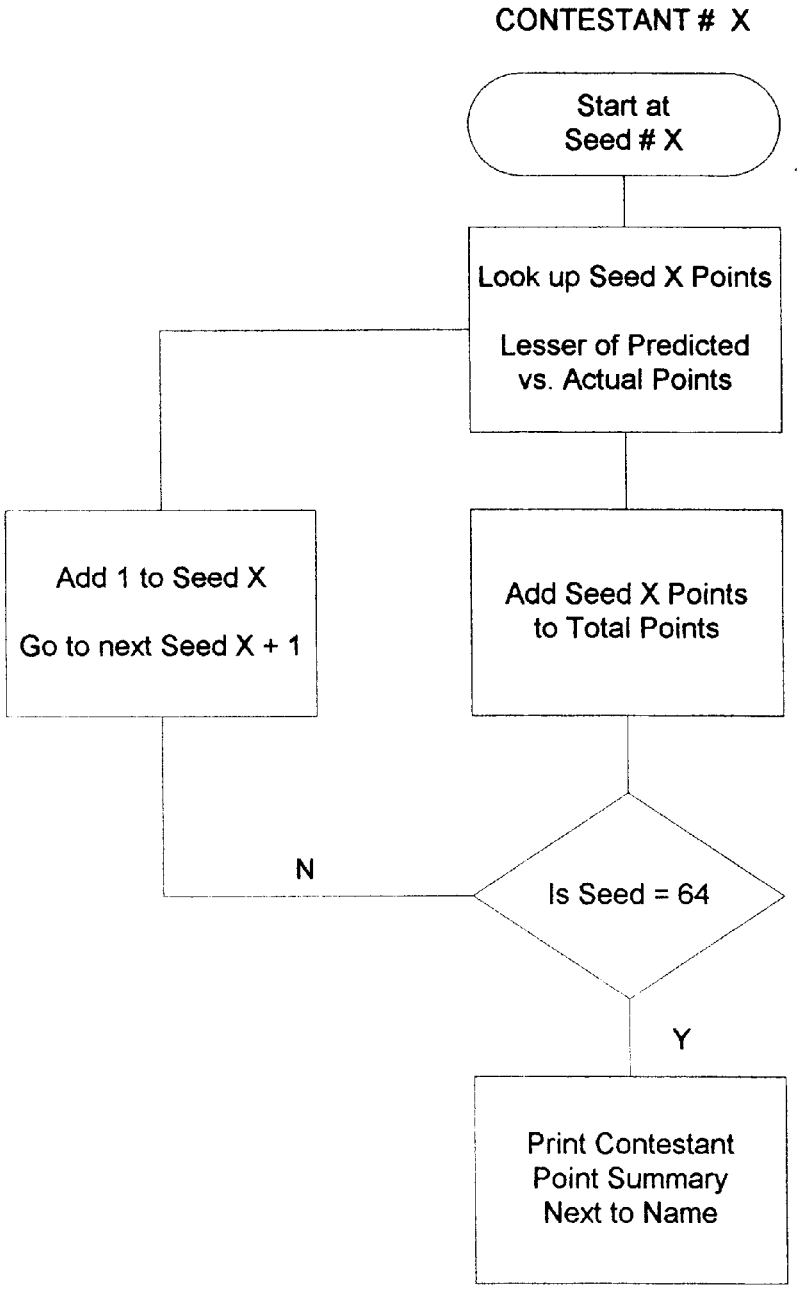
Figure 4C ( Con'd)

TOURNAMENT
ROUND

| SEED # | | Round 1 | Round 2 | Round 3 | Round 4 | Round 5 | Round 6 | | POINTS PREDICTED | ACTUAL POINTS | LESSER OF 2 |
|---|---|---|---|---|---|---|---|---|---|---|---|
| | | | | | | | | | | | |
| S1 | | W | W | W | W | W | W | | 20 | 20 | 20 |
| S2 | | W | W | W | L | - | - | | 16 | 4 | 4 |
| S3 | | W | W | W | W | W | L | | 8 | 16 | 8 |
| S4 | | W | W | L | - | - | - | | 8 | 2 | 2 |
| S5 | | W | W | W | W | L | - | | 4 | 8 | 4 |
| S6 | | W | W | W | L | - | - | | 4 | 4 | 4 |
| S7 | | W | W | W | W | L | - | | 4 | 8 | 4 |
| S61 | | L | - | - | - | - | - | | 0 | 0 | 0 |
| S62 | | L | - | - | - | - | - | | 0 | 0 | 0 |
| S63 | | L | - | - | - | - | - | | 0 | 0 | 0 |
| S64 | | L | - | - | - | - | - | | 0 | 0 | 0 |
| | | | | | | | | | | | |
| | | | | | | | | | | | |
| | | | | | | | | | | | |
| | | | | | | | | | PP | AP | CP |

FIGURE 4D

| Contestant 1st Name | Last Initial | Last 4 ss #s | Tournament Score | Tournament Rank | Rank by % |
|---|---|---|---|---|---|
| Pablo | A | 1012 | 83 | 830 | 17% |
| Travis | B | 6390 | 83 | 831 | 17 |
| Curt | C | 0077 | 83 | 832 | 17 |
| David | D | 1295 | 82 | 834 | 17 |
| Edward | E | 7117 | 82 | 835 | 17.5 |
| Frank | F | 0010 | 82 | 836 | 17.5 |
| George | G | 8929 | 82 | 837 | 18 |
| Hank | H | 3088 | 82 | 838 | 18 |
| Irving | I | 5567 | 81 | 839 | 19 |
| John | J | 3240 | 80 | 840 | 20 |
| Kevin | K | 1132 | 80 | 841 | 20 |
| Leroy | K | 0520 | 80 | 842 | 20 |
| Mark | M | 9815 | 80 | 842 | 20 |
| Nadine | N | 8774 | 79 | 844 | 20.5 |

Figure 5

100 POINT NCAA BASKETBALL TOURNAMENT GAME

This application claims benefit of Provisional Application No. 60/034,845 filed Jan. 27, 1997.

BACKGROUND OF THE INVENTION

This invention relates to wagering on the 64 team NCAA college basketball tournament amongst a large pool of fans. This invention provides systematic electronic means of entering predictions, calculating game points, ranking of contestants, along with online feedback mechanisms for providing overall results.

BACKGROUND—DISCUSSION OF PRIOR ART

The NCAA division I college basketball championship tournament has arguably become the biggest sporting event in the nation. In terms of legal gambling revenue, the first round of the 64 team tournament is second only to the Super Bowl in terms of total dollar volume wagered at Las Vegas casinos.

Professional gamblers and serious sports fans often enjoy participation in the tournament through legal wagering. Casino's traditionally offer gamblers legal wagering on the tournament in 2 ways; 1) select the overall champion, or 2) chose the winning team of a particular basketball tournament game matchup.

Under the 'chose the champion' wagering scenario, each of the 64 teams is assessed 'odds' as to their likelyhood in ultimately prevailing and winning the championship. Individual team odds typically range from 'even' payback for the top seed, up to 1000:1 returns should the lowest seed win the tournament. Odds are based on the dollar volume wagered on the various competing basketball teams. Odds can vary a great deal each year with the changing 64 team field.

Another popular method in which legal gambling on the tournament that takes place involves selecting the winning team involved in a particular matchup. Individual game slot wagering, of which the NCAA tournament has 63 available for betting, works quite differently than the 'pick the champion' scenario. Gamblers bet on 1 of the 2 competing teams, each assigned with reverseable odds of victory. Point 'handicap' betting is popular variation for wagering on individual tournament games. Under the handicap scenario, points are added or deducted from each of the teams final score. The overall margin of victory is the determining factor when assessing gambling victory or loss on the game. Under the handicap method of wagering, adding or subtracting preassigned point values from the competing teams under question determines whether a gamblers bet wins or loses. A team must 'cover the point spread' to prove to be a winning bet.

While a large market exists for serious gamblers, a larger market exists for casual gamblers. Less serious basketball fans, and even non-fans, often enjoy wagering in informal office pools. These type of tournament prediction games are often referred to as 'office pools' due to their popular implementation at many workplaces across the country.

These NCAA tournament office pool games are quite different from the gambling games available in traditional gambling centers. Unlike the gambling venues offered by casino's, informal office pools do not focus on determining the overall champion, or even on wagering on 1 particular matchup. These office pools require contestants to predict the entire 63 game tournament flow, from start to finish, prior to the start of play.

These overall tournament prediction games utilize the 'bracketed' matchup sheet determined by the selection committee as their ballots or game boards. NCAA tournament matchup sheets are printed in the sports section of any major newspaper the Monday morning after the tourney selections are made. Contestants fill in their predictions as to who they believe will win the 32 predetermined first round games. 16 second round match ups, or slots, automatically result by tournament design from the contestants first round predictions. 8 third round tournament slots or matchups can be determined from second round victory predictions. This method of predicting the entire 63 game NCAA tournament continues through all 6 rounds. Each contestants must predict winners for each of the 63 single elimination basketball game slots prior to the start of action to be eligible to compete within these tournament prediction games.

At the conclusion of the tournament, only 1 of 64 college teams remains, the division I college basketball 'national champions'. After the championship game concludes, tournament prediction contestant game points are totaled. Game points are based on predetermined game slot values for correct predictions, as recorded prior to the start of the prediction game. Each contestant will be assessed a 'score' for his tournament slot predicting skills. Ultimately, a tournament prediction game winner(s) is then determined amongst the pool of contestants based on the point assessment formula preagreed to.

Each of these prediction tournament game pool employs its own unique method of assessing points for the contestants ability to 'pick the winners'. Later round game slot winning predictions are virtually always assessed greater point values than early round predictions. Points are often weighted in a simple linear fashion, increasing by some preset value as the tournament rounds progress. A typical linear point system might award 1,3,5,7,9, and finally 11 points for each correct slot victory prediction through all 6 NCAA tournament rounds. Some other game pools employ an exponential weighing of points between rounds. Victory predictions for game slots can go from 1,2,4,8,16, up to 32 points from rounds 1 thru 6 under this type of point awarding system. These exponential point systems usually place far greater emphasis on getting the tournament finalists correct than do their linear counterpart systems.

The typical college basketball fan can choose from the formal betting scenario's offered by casinos, or participate in an entire-tournament-prediction game. Often time neither of the two formal gambling methods, 'pick the champion' or individual game wagering, satisfies the pyschological wagering needs to the less serious fans. Many casual fans consistantly abstain from state sanctioned wagering. Indeed some states do not even allow for legalized betting on college games. Lack of available gambling venues can result in normally law abiding fans to seek out dangerous, illegal operations to place bets.

By and large, the typical basketball fan prefers the 'pick the entire tournament' prediction game over the institutionalized styles of gambling on the tourney. The tournament prediction game offers positive socialiability benefits while omitting the compulsive effects and pressures often associated with casino wagering. But these informal NCAA tournament prediction game pools, through their inconsistent and/or variable point schemes and small paybacks, often do not fully satisfy the wagering needs of many game contestants.

Tournament prediction game pools do not offer contestants the ability to measure their performance against counterparts in other similar pools. Contestants can not easily determine how well their prediction sheets performed against friends and relatives playing in other parts of the country. The byzantine arrangement of NCAA prediction game point methods do not readily allow a fan to 'average his scores' on how well he has predicted tournament results over a ten year period. The lack of a standard point assessment methodology for correct predicting does not allow the fan to compare his ability against the expert selection committee. The lack of consistent point system amongst pools does not allow for comparison between contestants involved in different point assessment tournaments. In short, a great deal of the drama and excitement of the tournament is needlessly eliminated from contestant enjoyment. A lack of consistent scoring means between NCAA basketball prediction game pools across America turns many fans from potential active participants into passive television viewers.

All NCAA basketball prediction games heretofore known suffer from a number of deficiencies. The primary problems with traditional 'pick the entire tournament' games available to contestants include;

A) There is no commonly available means for a casual fan to wager on the entire tournament flow, via predicting the victors in all 63 game slots. Fans are limited to two styles of traditional casino wagering on the NCAA tournament; 1) predict the overall champion, or 2) pick the winner of a preselected matchup, possibly involving a handicap system. If they do not have access to a group run prediction game, they aren't able to participate in this more enjoyable style of wagering.

B) Contestants involved in prediction games typically must use newspaper printed tournament ballots as a means of entering slot winner selections. Handwritten means of choosing game slot winners can be difficult to read, or mistakenly transcribed, due to problems with legibility.

C) A wide variety of tournament predicting game scoring means are employed around the country. The lack of a standard point methodology does not facilitate comparison of prediction scoring amongst outside game pools. Objective analysis of expertise between contestants involved in different prediction games breaks down into subjective guesswork. Arguments regarding contestant expertise on college basketball are left unresolved.

D) The patchwork of point scoring systems results in a lack of any meaningful way to benchmark tournament years in terms of excitement. Some tournaments involve large number of dramatic upsets, or 'cinderella' style victories of unlikely tournament champions. Without any standard quantitative means of measuring these collective tournament incidents, a means of communicating and recalling the drama is lost.

E) Small tournament game pools are the rule of tournament prediction games. The informal nature of these pools, often restricted by time and energy limitations of the overall pool organizer, keeps participation low by design. Amateur prediction pool tournament games are often restricted to hand calculations to determine overall winners. These logistical issues directly impact the pool size, and its associated payout.

F) The patchwork of small prediction games provides no real time means for contestants to inquire on their accumulated prediction score as tournament basketball games conclude around the country. Contestants must break out their pencils, and erasers, to see how their predictions are turning out relative to their peers. The alternative to the less math inclined contestants is to wait until the following morning when the prediction game chairman/commissioner reports the scores. The prediction games assigned tournament chairman may not bother to calculate contestant scores until the tournaments conclusion.

G) Informal prediction games typically lack preagreed/predetermined tie breaker methods to determine contestant placement in the event of matching prediction game scores. Many pools simply allow the tied winners to split the prize. That policy may not always satisfy the needs or desires of the contestants. A tie breaker standard for these tournament prediction games is lacking.

H) Small pools lack a common posting forum of prediction tournament score results. This should be available to the contestants for tracking purposes. Most of the contestants involved with prediction pools must provide their own tracking mechanism, typically recorded on a piece of paper kept in his possession. This lack of a focused bulletin board for results detracts from the overall enjoyment of the game participants.

OBJECTS AND ADVANTAGES

Accordingly, several objects and advantages of my 100 point NCAA basketball tournament prediction game are;

A) Availability of a common, worldwide 'predict the entire NCAA tournament' game and system. Contestant would be offered the opportunity to participate in a professionally managed system courtesy of strategic implementation of traditional and internet communications technologies. Nobody who is interested in participating in this style of wagering competition and/or entertainment would be denied the opportunity to play.

B) Use of webpages and other electronic means for entering tournament predictions. Contestants can place their bets literally minutes after the selection committee posts the tournament. Webpage entry selection also eliminates the issue of illegible handwriting that can occur through newspaper form entries. Electronic entry also allows for time stamping, in case of disputes regarding eligibility.

C) Adoption of a 100 point system to measure contestants ability to predict the NCAA tournament. The vast majority of fans involved in the wagering were educated in American schools. These fans have a preconditioned mindset regarding 100 point scales. Prediction scores in the 90's, 80's, and 70's point range already have a prebuilt emotional response with fans that non centurian scales can not emulate.

D) A simplified means of tracking individual tournament year and/or contestant overall performance. Courtesy of the easy-to-use/easy-to-remember 100 point scoring system, a simple 'grade' can be applied to both expert and amateur game results. The 100 point prediction game point total leverages a lifetime of test taking to bring an added grading dimension to contestants. Grading assisting contestants in remembering their results.

E) Incorporation of data processing equipment, which allows for a much greater number of contestants to participate in the prediction game. The greater the number of contestants involved in the prediction tournament, the larger the winnings available to be had at its conclusion. Larger pools create more interest, which translates into more fun for tournament prediction game contestants.

F) Utilization of data processing equipment to determine contestant scores realtime as tournament basketball games conclude. Prediction game contestants can be continually updated of their acculumated scores in comparison to large numbers of their peers. around the country. Data processing tools also greatly reduce the likelyhood of errors in point calculating.

G) Establishment of a tiebreaker scenario in the inevitable event of tied scores that result from a large pool of prediction tournament contestants. Final and Semifinal game margins of victory can be employed to determine which contestant places ahead of the other in the event a tiebreaker scenario is needed. Advanced tiebreaker rules could even allow for the possible selection of a 'national champion' in regards to tournament prediction skills. Such a title would endow the recipient with recognition and other forms of tangibles and intangible rewards.

H) Use of electronic point posting tools such as the internet to track individual contestant and group results. Electronic posting allows for a variety of interesting ways of tracking contestant results. For example, the individual contestant can track his results against his selected peer group, against his region, or against every other contestant worldwide. Further objects and advantages of my invention will become apparent from a consideration of the drawings and ensuing descriptions of them.

DESCRIPTION OF DRAWINGS

In these drawings, reference items have been given alphanumeric suffixes as opposed to mere numbers. These alphanumeric suffixes are based on abbreviations that reflect their longer titles, and as such. The 'intelligence' built into these suffixes are meant to simplify the task of association for the reader.

FIGS. 4A through 4D shows a software flowchart which determines how many prediction game points the contestant is assigned to each of his 64 seed predictions. At the conclusion of the tournament, each seed is assessed a point value based on their actual performance. The prediction game algorithm for calculating points takes the lesser of the actual vs. the predicted points for each of the 64 seeds in accordance with the game rules.

FIG. 5 demonstrates posted rankings of a group of contestants with scores around our ficticious contestants 82 point total. Ranking and percent rankings are shown to give the contestants a feel for how well their overall tournament prediction formula performed. Rankings could be used to determine payouts or prizes for higher placing contestants.

REFERENCE NUMERALS AND SUFFIXES IN THE DRAWINGS

S1 through S64—NCAA college basketball tourney teams, top #1 seed through #64 seed
R1 through R6—The 1st through 6th rounds of the elimination style tournament
X—the X axes
Y—the Y axes
LF1—linear function
XF1—exponential function
DF1—discontinuous function,1st example
DF2—discontinuous function,2nd example
U1—upset #1
U2—upset #2
PP—predicted tournament game points for seed
AP—actual tournament game points for seed
CP—contestant game points awarded for seed

DESCRIPTION OF THE INVENTION

Figure 1A:
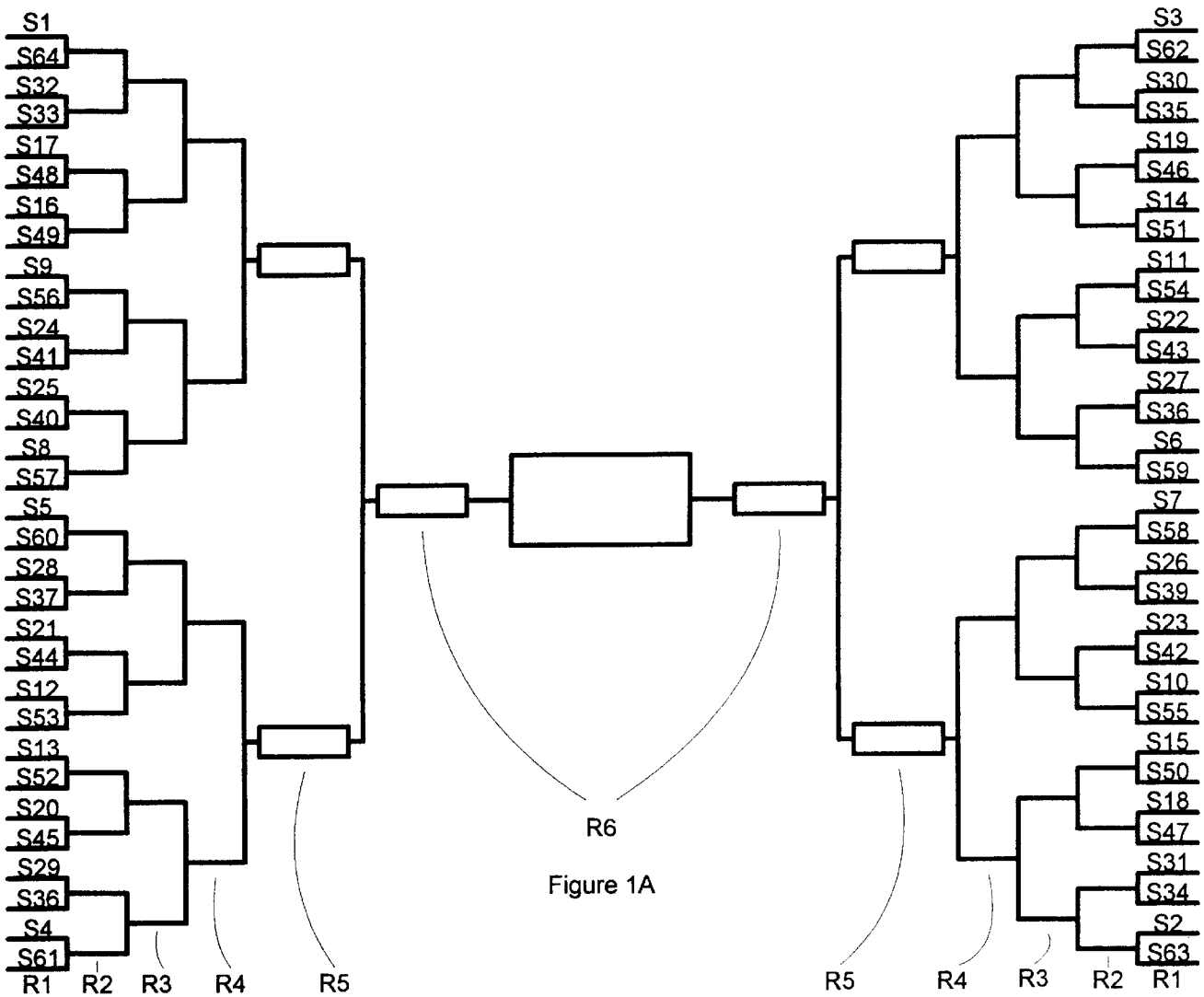
FIG. 1A shows the NCAA 64 team basketball tournament seedings and format, as structured by the selection committee. This tournament arrangement shall act as the common 'game board', with contestants predicting the victor for all 63 elimination game slots prior to the start of the tournament.

FIG. 1A shows the basic format of the 64 team NCAA college basketball tournament. The NCAA selection committee rates each team in terms of its likelyhood of winning the tournament. This ranking is the basis behind its 'seed' value, with the top team evaluated as the #1 seed S1 in FIG. 1A. To make the tournament both more interesting and more fair. the seeds are evenly dispersed into 4 regional tournaments. First round tournament matchup games are based largely on overall seed rating, with the selection committee designing the matchups evenly across the regions. In actual practice, the tournament does not follow the theoretical perfect seeded arrangement of perceived abilities. Seeding of teams can be manipulated to maximize local fan interest and television revenues. The winners of these regional tournaments advance to the 'final four' or semifinal round R5. The tournament championship game, round R6, is typically played on a Monday evening around the end of March each year.

FIG. 1 A shows the beginning bracketed format which shall act as the tournaments basic 'game board'. The ability of the contestant to predict how the final board looks at the conclusion of the tournament is the key to determine who wins the 100 point prediction game. As such, contestants need to fill in the 63 open slots available within FIG. 1A, choosing which of the seeds advance through the various slots towards the championship.

The NCAA basketball tournament form shown in FIG. 1A is typically printed in newspapers around the country the Monday after the seeding matchups are announced. This format printout can act and does act as a ballot for many of the NCAA basketball tournament prediction game pools conducted nationwide. Contestants can enter their predictions for all all 63 slots through handwritten or typed means. All 63 game slot victors must to be forecasted by the contestant before the commencement of the tournament as a standard rule of wagering eligibility.

The online tournament prediction game advocates the use of electronic entry of contestant prediction flows over written means. Internet entry of the tournament displayed in FIG. 1A is a faster, more reliable, and more direct approach for a contestant to enter their tournament slot selections. A webpage could easily be designed and implemented to enable the contestant to make his selections through a computer and across the internet. Webpage entry of slot predictions better accomodates data processing point tracking and recording systems needed by large pools of contestants. Entry fees and/or online wagers could be communicated via a credit card through the use of online services.

This inventions incorporates use of a webpage entry form as shown in FIG. 1A. The webpage approach also offers ease of use advantages for contestants. These computerized data tools better allow for a larger pool of contestants to participate in the prediction game.

Figure 1B:
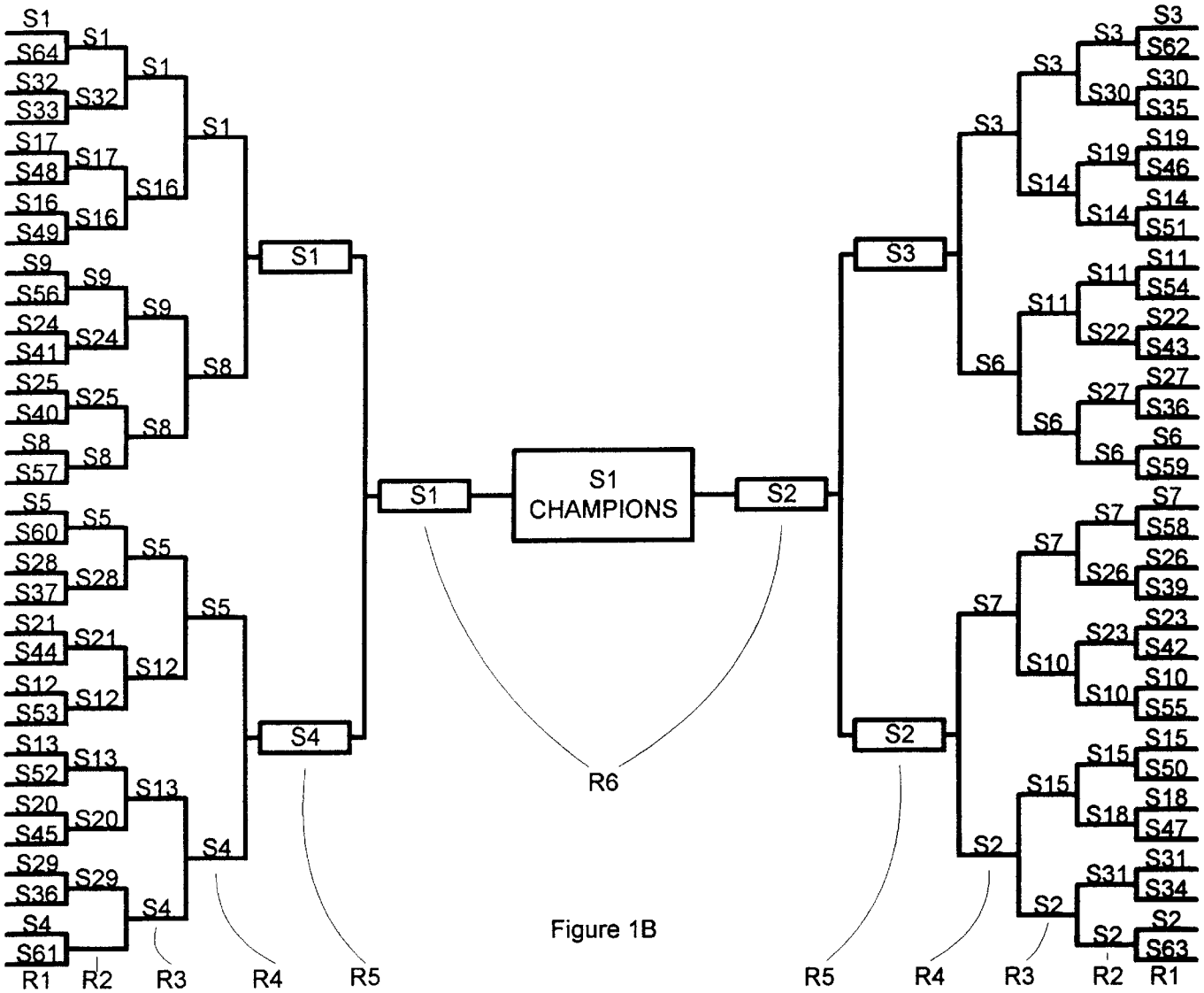
FIG. 1B shows a completed entree form, with the contestant having filled out the entire 63 game tournament as he believes it will unfold. For simplicity sake, our theoretical contestant entry exactly matches the tournament selection committee in terms of victory predictions and overall flow.

FIG. 1B shows the completion of a contestants NCAA basketball tournament entry form selections. In this example, the contestant predicts that all 64 seeds will perform exactly as predicted by the selection committee. Seed S1, representing the top seeded team, advances to the championship game. S2, or the tournaments 2nd seed, loses to team S1 for the championship. If the actual tournament flows exactly as this ficticious contestant predicts, he'll score a perfect 100 points at the conclusion of the game.

To date, there has never been a 64 team NCAA college basketball tournament which has not included a plurality of upset victories by lower seeded teams. It is these upset victories that make for a great deal of the the tournaments drama. Prediction of upset victories by contestants makes this tournament prediction game both more fun and interesting for them. How upset victories impact contestant point assessment is another factor that separates this invention from other more traditional prediction games.

A key driving factor behind all of these tournaments is how points are assessed for correct slot predictions. How points are weighed for correct slot predictions can greatly add to the enjoyment of the contestants wagering experience. In order to understand the advantages of this inventions 100 point award system, the typical linear and exponential point systems will also need to be discussed in detail.

This prediction game invention incorporates a 100 point system based on a discontinuous point function. This 100 point system allows contestants a simple numeric means of grading their results. The 100 point scale employed in this system holds contestant interest longer into the tournament by placing greater emphasis on early upset predictions than do its linear or exponential point system counterparts. It is this 'reward-for-choosing upsets' game design factor that ultimately encourages contestants to play more boldly.

Figure 2A:
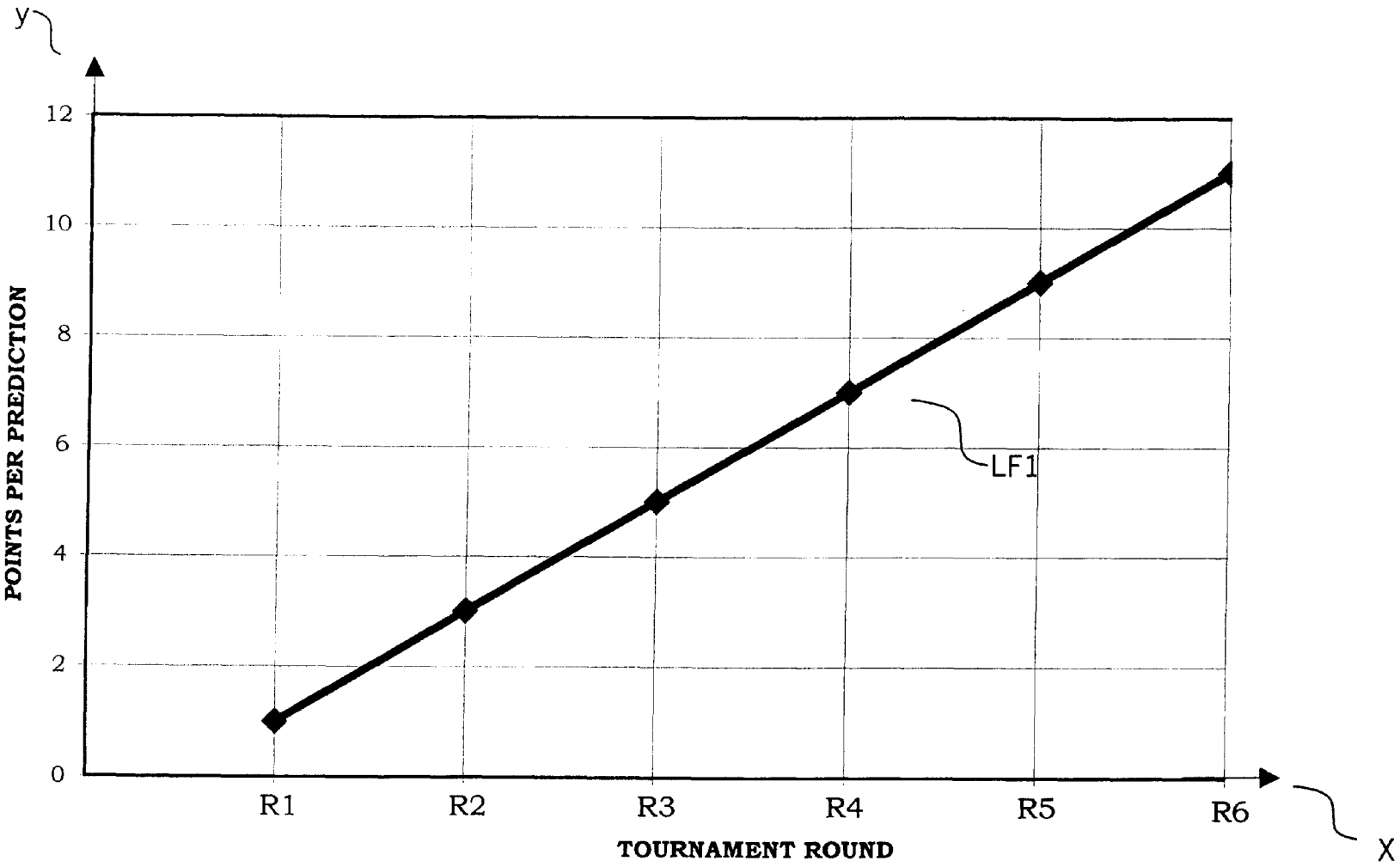
FIG. 2A shows a typical linear style point awarding system for predicting the NCAA basketball tournament. Per this system, there are 32 first round points, 48 second round points, 40 third round points, 28 fourth round points, 18 fifth round points, and 11 sixth round or championship points. Per this linear point method, there are 177 points available to each contestant within this particular system.

FIG. 2A shows a typical linear based point system utilized in traditional tournament pools. In FIG. 2A linear point system, each preceeding round is worth 2 additional points per prediction. One point is awarded for each correct 1st round prediction. In subsequent rounds R2 through R6, 3, 5, 7, 9, and 11 points are awarded for the contestants ability to predict the winner ahead of the tournament starting point. Altogether, 177 points are available under this type of linear prior art system.

Figure 2B:
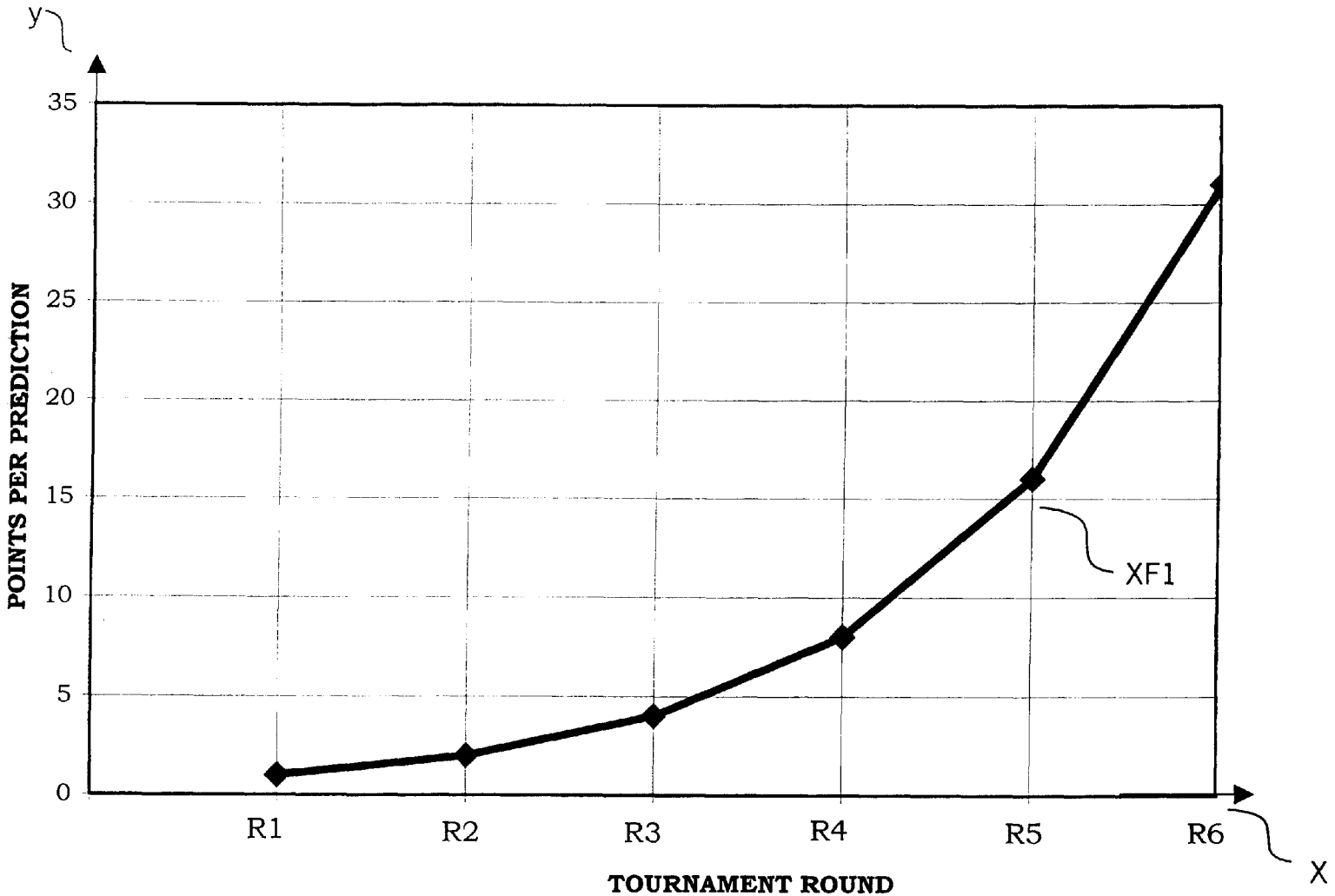
FIG. 2B shows a typical exponential point awarding system for predicting the NCAA basketball tournament. Per this system, there are 32 first round game points, 32 second round points, 32 third round points, 32 fourth round points, 32 fifth round points, and 32 sixth round or championship game points. Per this exponential point system, there are 192 points available to each contestant for his tournament slot predictions.

FIG. 2B shows a point awarding system based on an exponential formula for awarding correct tournament predictions. As the rounds advance from R1 through R6, the points awarded for each correct tournament prediction double relative to the previous round. In this prior art example, prediction victory point values increase from 1 to 2, 4, 8, 16, and ultimately 32 championship game points. Each round under this exponential point system is worth 32 points, with 32 games times 1 point in round R1, 16 games times 2 points in round R2, etc. Altogether there are 6 times 32 or 192 total points available under this exponential system.

Figure 2C:
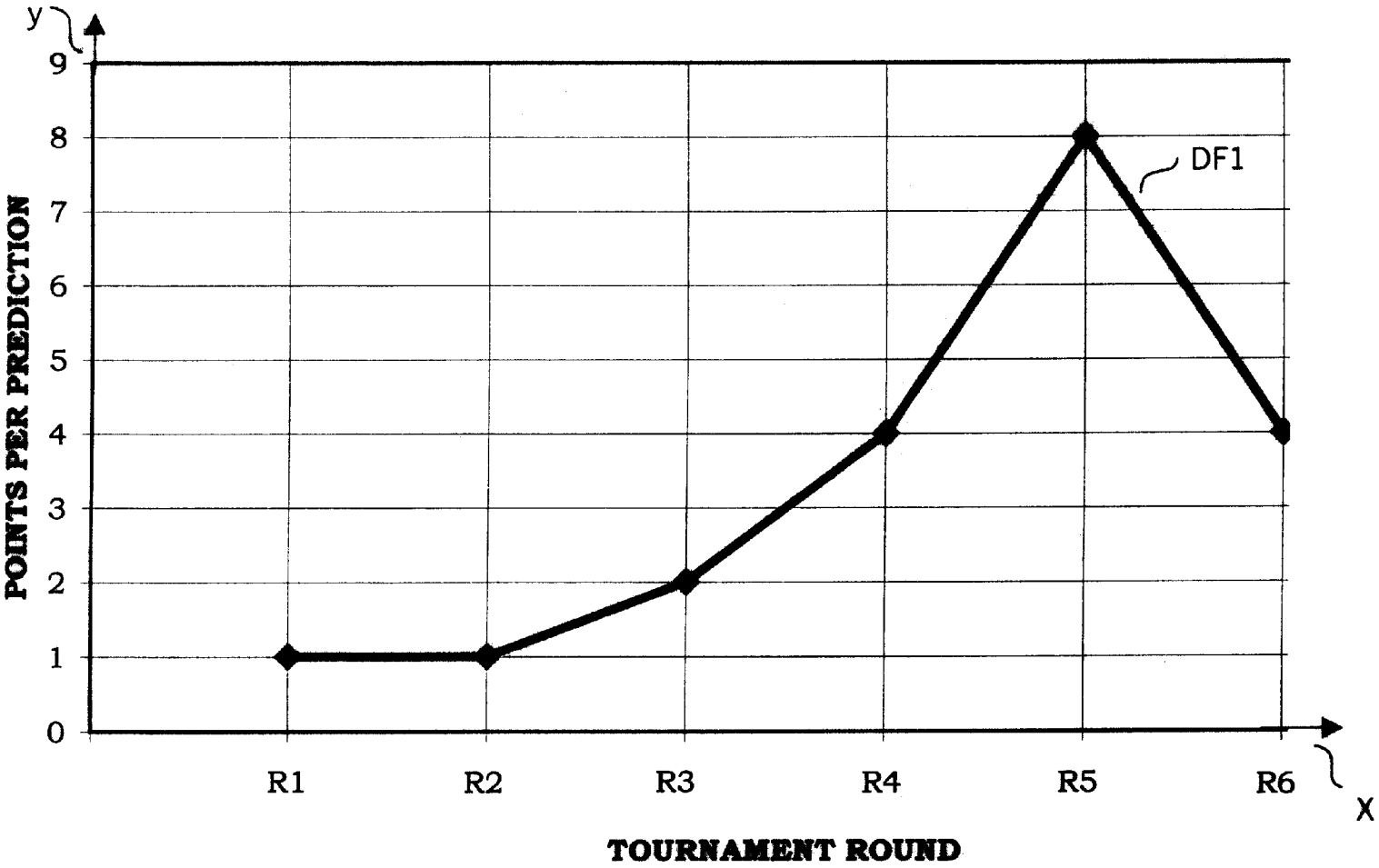
FIG. 2C shows a 100 point prediction award system. The system shown is based on a discontinuous functional point distribution representative of this invention. Per this system, there are 32 first round points, 16 second round points, 16 third round points, 16 fourth round points, 16 fifth round points, and 4 sixth round or championship game points. There are 100 points available overall for contestant predictions within this point system.
Figure 2D:
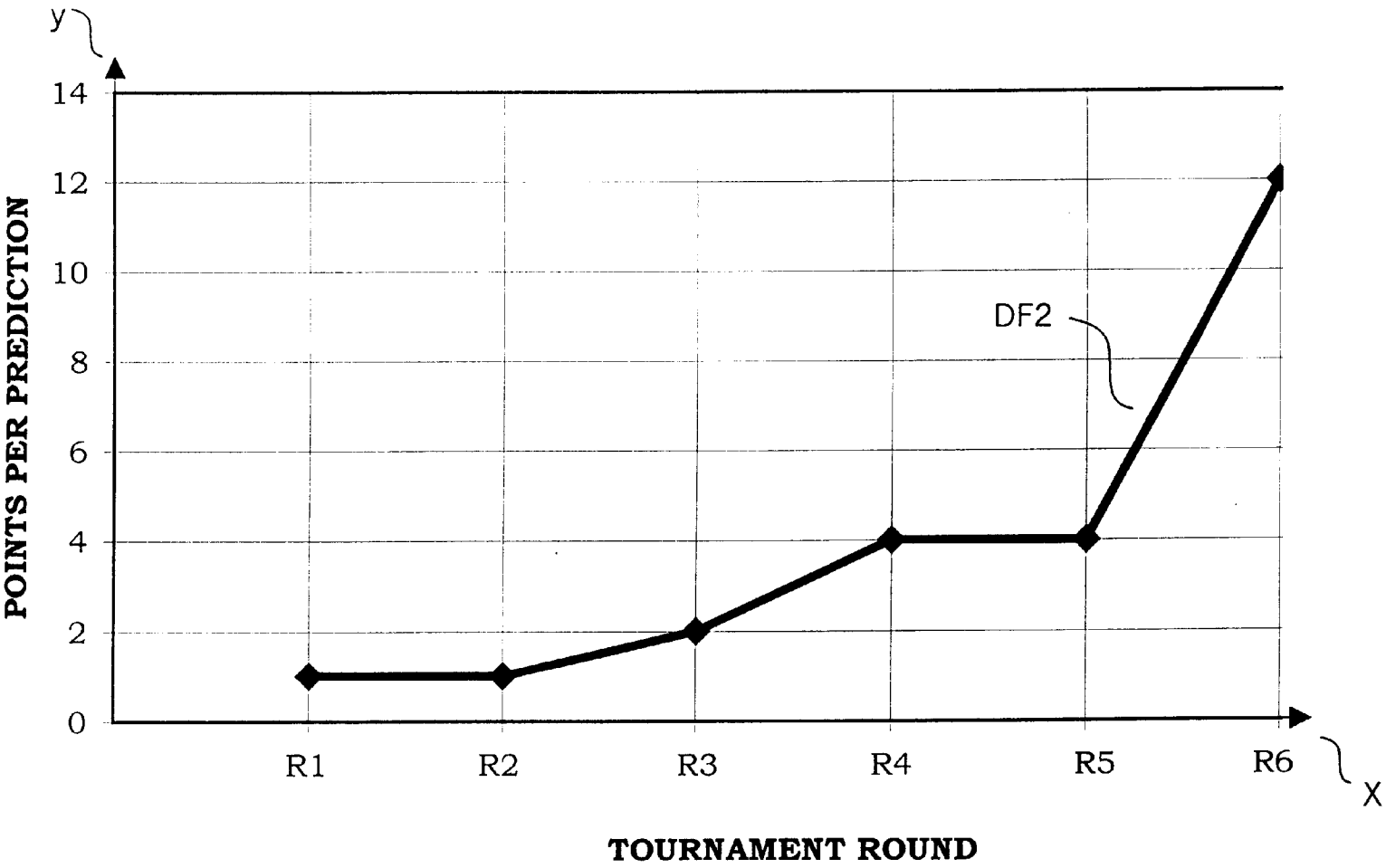
FIG. 2D shows another 100 point award system for tournament contestants. The points per round are again based on a discontinuous function as proposed under this invention. There are 32 first round points, 16 second round points, 16 third round points, 16 fourth round points, 8 fifth round points, and 12 sixth round or championship points.

FIGS. 2C and 2D represent 100 point systems for predicting the NCAA tournament, as advocated by this invention.

The 100 point system of FIG. 2C shows rounds R1 through R6 on the X axes, and the points awarded per prediction for each round on the Y axes. Unlike the continuous functions represented by the linear and exponential point awarding systems, the 100 point system shown in FIG. 2C is a discontinuous function. There is no single simple mathematical formula to describe the discontinuous function DF1 shown in this figure. There are basically 3 different formulas shown in this diagram; 1 point for round R1 predictions, and exponential formula for point awarding from rounds R2 through R5, and 4 points awarded for predicting the correct winner of the championship game in round R6. It is only by following a discontinuous function across the six tournament rounds that that the desireable 100 point total can be arrived upon.

Unlike the simple linear and exponential point prediction systems previously discussed, spreading 100 points over the 63 single elimination games is not so simple and direct. Under the 100 point system, with its atypical approach to point assessment, that result in the advocation of data processing calculation tools.

FIG. 2D shows another means of achieving 100 points total for the NCAA basketball prediction game. Rounds 1 through 6 are again plotted on-the X axes, while the points per prediction are plotted on the Y axes. Discontinuous function DF2 is shown in FIG. 2D, again with no simple single point formula available to total 100 points over 63 single elimination games. There are no less than 4 functions describing point values per round of each correct prediction in the discontinuous function shown in FIG. 2D. For round R1, 1 point is awarded for each correct prediction. Rounds 2 through 4 obey an exponential function, doubling in point per correct prediction across rounds R2 through R4. The tournaments semifinal round R5 awards 4 points for a correct prediction per function DF2. Finally, the championship round R6, awards 12 points to the contestant for a correct prediction, or three times the value of a semifinal prediction. All together, discontinuous point function DF2 breaks out its 100 point total as follows; 32 points awarded in round R1, 16 points in round R2, 16 points in round R3, 16 points in round R4, 8 points in round R5, and 12 points in round R6.

The static description of this NCAA basketball prediction game advocates 3 aspects missing from traditional game pools; 1) online entry of contestant predictions for the 63 game slots, and 2) contestant score assessment based on a 100 point discontinuous function across the six rounds, and 3) use of electronic data processing tools to calculate scores for a large number of contestant participants. A more fluid description of the significance of these three factors is described in the examples described in the Operation section below. A fourth and final dimension associated with the implementation of this prediction game invention, online posting and retrieval of scores, is also discussed.

OPERATION OF THE INVENTION

To lend to the overall clarity of the explanation of this inventions operation, a ficticious contestant game slot selection form and a ficticious tournament game are employed. This simulation is meant to provide the reader with a better means to understand the prediction game under actual operating conditions.

The 4 basic system aspects of this game under operation include; 1) online entry of tournament predictions. 2) 100 point scoring distributed over 63 game slots, 3) employment of data processing tools to assess contestant results, and 4) posting of contestant results on the internet for instant retrieval by contestants.

Figure 3:
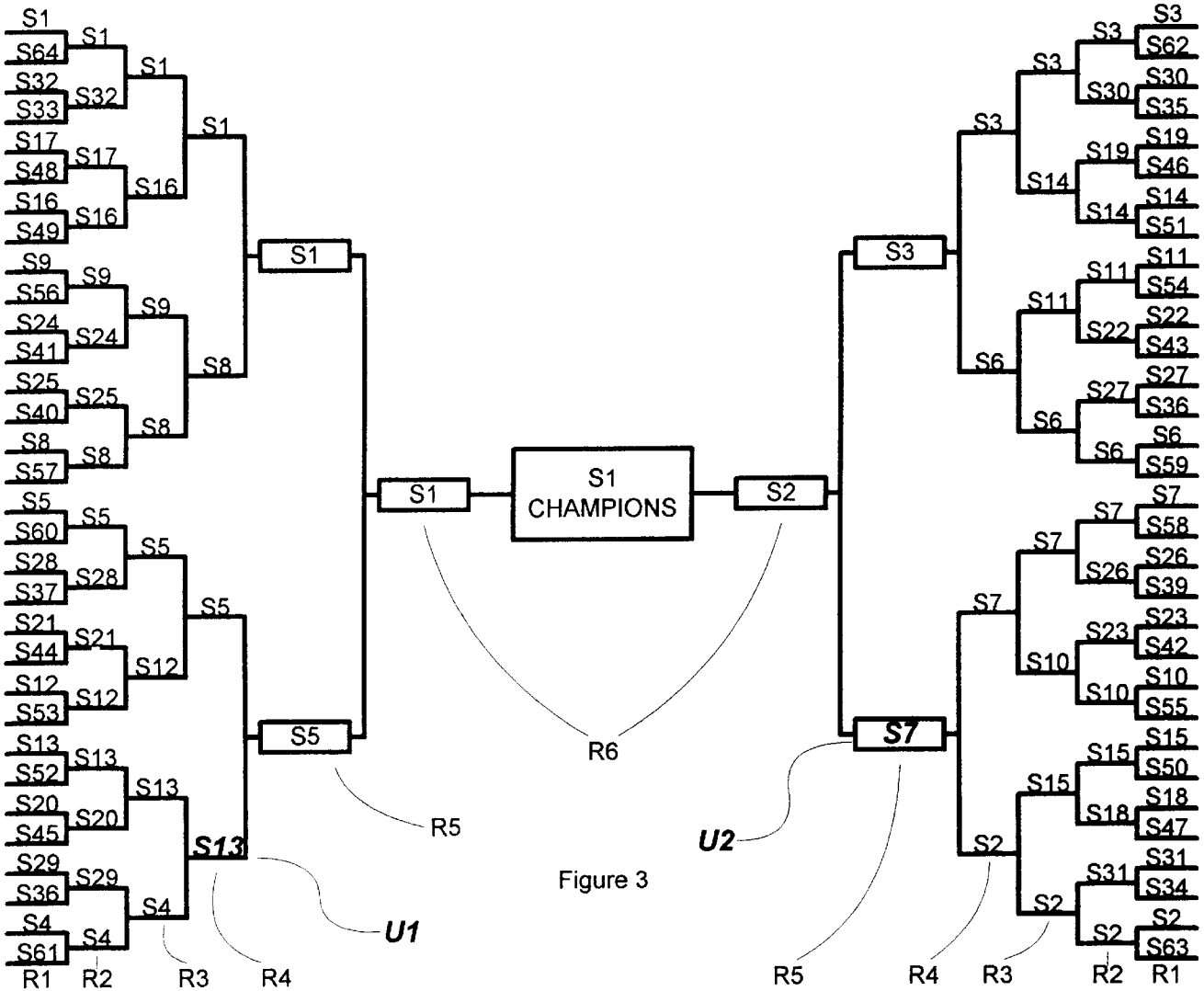
FIG. 3 shows a ficticious NCAA tournament flow for the purposes of invention explanation. In this demonstration tournament, only 2 of the 63 tournament game slots involve upset victories by a less favored team. In round 4, the tournaments #13 seed defeats the #5 seed. In the 5th or semifinal round, the #7 seed upsets the #2 seed.

FIG. 3 depicts a ficticious NCAA college basketball tournament upon its completion. This ficticious tournament final flow diagram would be compared against individual contestants prediction flow sheet as entered prior to the start of the tournament. Simple point calculations, based on a discontinuous function for correct slot predictions across rounds R1 through R6, would determine how many points the contestants receive at the conclusion of the game and tournament. Typical calculation flowcharts are shown in FIGS. 4A through 4D. FIG. 5 depicts a final point tally for retrieval amongst a number of contestants participating in the basketball tournament prediction game.

As in any current, modern day NCAA basketball tournament, there are 63 single elimination tournament games leading up to the champion. FIG. 3 shows a ficticious flow, with 61 of 63 games resulting in the lower seeded team prevailing over its perceived weaker higher seeded counterpart. As an example, notice how the tournaments highest seeded team S1 advances past the first round R1 through R2, R3, R4, R5 and ultimately the championship game in round R6. Competing higher seeded teams that encounter top seeded team S1 are eliminated from the tournament. Teams eliminated by top seed S1 on its march to the championship include tournament basketball seeded teams S64, S32, S16, S8, S5, and S3 in the finale. Most of this activity was intuitively anticipated by the NCAA selection committee that seeded S1 as the overall favorite. That seed S3 made it to the championship, however, was not anticipated by the experts.

Note that 2 important upsets occured in our ficticious tournament as shown in FIG. 3. An upset is defamed as a victory by a less favored team over a more favored one. In terms of this invention, an upset translates into a team with a higher S or seed number victoriously prevailing over a lower or favored S number. The first upset depicted in the ficticious tournament shown in FIG. 3 is upset U1. In upset U1, seed S13 triumphs over seed S4 in round R4. The second and final upset of the tournament occurs in round R5. This tournament upset victory, labeled U2, involves seed S7 defeating seed S2.

FIG. 3's upset victories allow 2 teams, seeds S13 and S7, to advance one additional round into the college basketball tournament. The significance of these tournament upset victories to the contestants involved in the 100 point prediction game is usually great. Contestants who forecasted that basketball seeds S5 and S7 would advance one additional round would be handsomely rewarded in points for their shrewd tournament slot selections. These contestants award would appear in the form of game points deducted from their competing prediction game contestants who had not foreseen these upsets.

The ability of contestants to predict upset victories, and thus projections of all 64 seeds throughout the tournament slots, acts as the psychological driver of all of these prediction games. This inventions 100 point system yields greater rewards to individuals willing to go with their own intuition. Early round upsets are more handsomely rewarded under the 100 point game system when compared to traditional linear and exponential point systems.

The 100 point discontinuous point system advocated by this invention allows the contestants the added satisfaction of being able to grade their performance. In typical American schools that most of the contestants attended, a score of 90 out of 100 points translates into an A, 80 out of 100 translates into a B, etc. The added psychological power of the grading scale allows contestants to tap into preestablished patterns of skill comparison. This games pleasure involving the additional grading factor dimension to final scores can be amplified through contestants correctly choosing upset victories. Where, when, and who will be involved in these tournament upset victories such as U1 and U2 is critical for contestants towards generating point totals.

Applying the 100 point discontinuous point award system advocated by FIG. 2C for the tournament upsets shown in FIG. 3 demonstrates firsthand the importance of upset predictions. For upset U1, contestants picking underdog victor S13 over favorite S5 would be awarded 2 additional points over contestants who incorrectly predicted the favored squad. Upset U2, which occurs in a later round R4, would award contestants making this prediction an additional 4 points over competing counterparts who picked the favorite to prevail during this anticipated slot matchup. The 6 points awarded for contestants who correctly predicted these later round upset victories can more than offset a few earlier round selection mistakes. Single point round R1 or R2 incorrect predictions the contestant may have mistakenly selected can be easily made up through later round upsets projections.

Any contestant whose pre-tournament prediction entrees exactly matched the flow of the ficticious tournament shown in FIG. 3 would score a perfect 100 points. In actual practice, this type of precision predicting, while not impossible, is exceedingly difficult for contestants to achieve. Individual contestants, given their own whims, insights, and prejudices, will show very individual approaches toward tournament predictions. There is a huge number of selection paths, otherwise known as mathematical permutations, available to contestants.

With the advent of computer networking, a large number of possible game contestants are available for this tournament game. As such, employment of data processing equipment to calculate and post contestant prediction scores is essential to manage the type of large online tournament this invention envisions and advocates.

FIG. 4 shows a flowchart for calculating the number of overall game points predicted for each of the 64 seeded teams based on a contestants tournament slot projections. For demonstration purposes, assume that a contestant chose to base his tournament team predictions to exactly match those of the NCAA selection committee. FIG. 1B shows a tournament prediction flow that exactly matches the selection committee projections.

Our prediction game contestant will have projection paths established upfront for each of the 64 teams competing in the NCAA college basketball championship. These projections will be recorded on a tournament flows 63 slot ballot, electronic or otherwise, such as shown in FIG. 1B. These seed projections ultimately end up residing in computer memory. Each seeded team will have an inherent predicted point value assessed to them based on the prediction game contestants flow pattern through the 63 game slot paths.

Figure 4A:
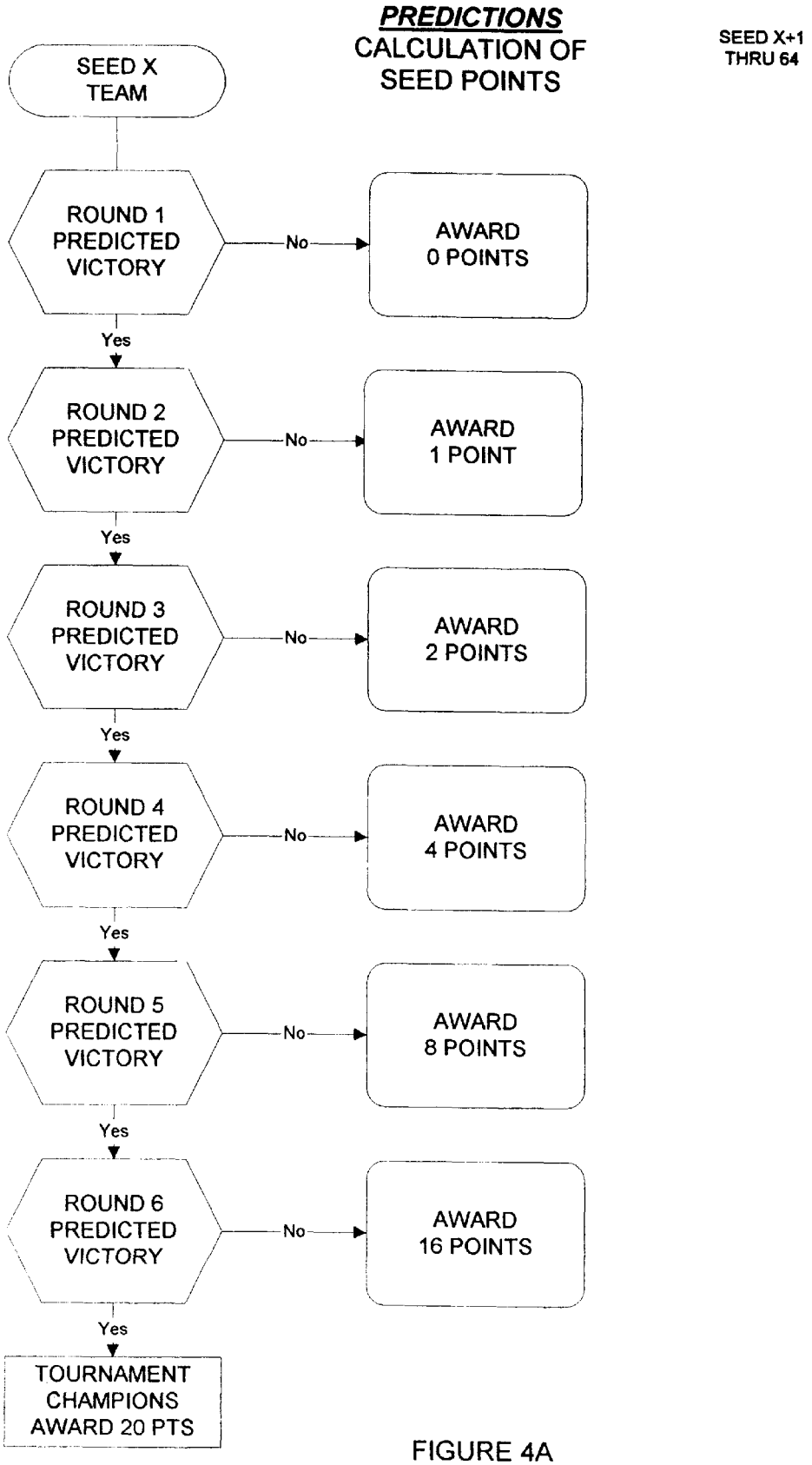

The prediction flowchart shown in FIG. 4A is used to assess how many game points are anticipated for each of the 64 seeds based on the contestants slot selections. The 100 point system based on the discontinuous point formula discussed in FIG. 2C is implemented throughout the flowchart shown in FIG. 4A. According to our game contestants predictions, top seed S1 would proceed through all 6 rounds, and end up as the tournament champion. In terms of the flowchart example shown in FIG. 4A, seed S1 victories would flow through rounds R1 through R5 and to the bottom square of the flowchart. As the NCAA tournaments projected champion, the ficticious contestant predicts seed S1 will accumulate 20 game points, the highest point total available to any single competing team.

Examination of other contestant tournament slot projections as shown for various seeds in FIG. 1B helps to further clarify how game point values are assessed. Sixteenth seed S16 is projected by the ficticious contestant to advance past the first round R1, the second round R2, and be eliminated from the tournament during round R3. Now we can put this projection pattern for seed S16 into the flowchart shown in FIG. 4A. According to the discontinuous point formula loaded into flowchart 4A, 2 points are predicted for seed S16 by our contestant. Contestant seed projections and associated point predictions for all 64 teams could be determined through the electronic implementation of a FIG. 4A's flowchart onto a computer.

By the prediction game design, half the teams competing in the NCAA basketball tournament will be projected to accumulate zero points. According to our contestants predictions shown in FIG. 1B, all first round games in round R1 will result in the favored lower seeds proving victorious over their lower seeded matchups. As such, seeds S33 through S64 will be uniformly eliminated afier the first round R1. According to the flowchart shown in FIG. 4A, tournament elimination during round R1 results in a seed receiving zero predicted points. The total number of points our contestant predicts seeds S33 through S64 will collectively accumulate is zero. All that needs to occur for our ficticious contestant to be wrong is for a single upset to occur in the first round R1. Any additional advancement of any lowered seeded team into further rounds beyond R2 further penalizes the contestant in points denied for incorrect slot predicting.

In actuality, no single 64 team NCAA basketball tournament in history has experienced a first round in which all 32 favored teams were victorious over their less favored competitors. The upset victories are what make the tournament so dramatic to observe. Prediction game competitors derive a great deal of pride by virtue of their ability to predict where and when these upset victories will occur.

Figure 4B:
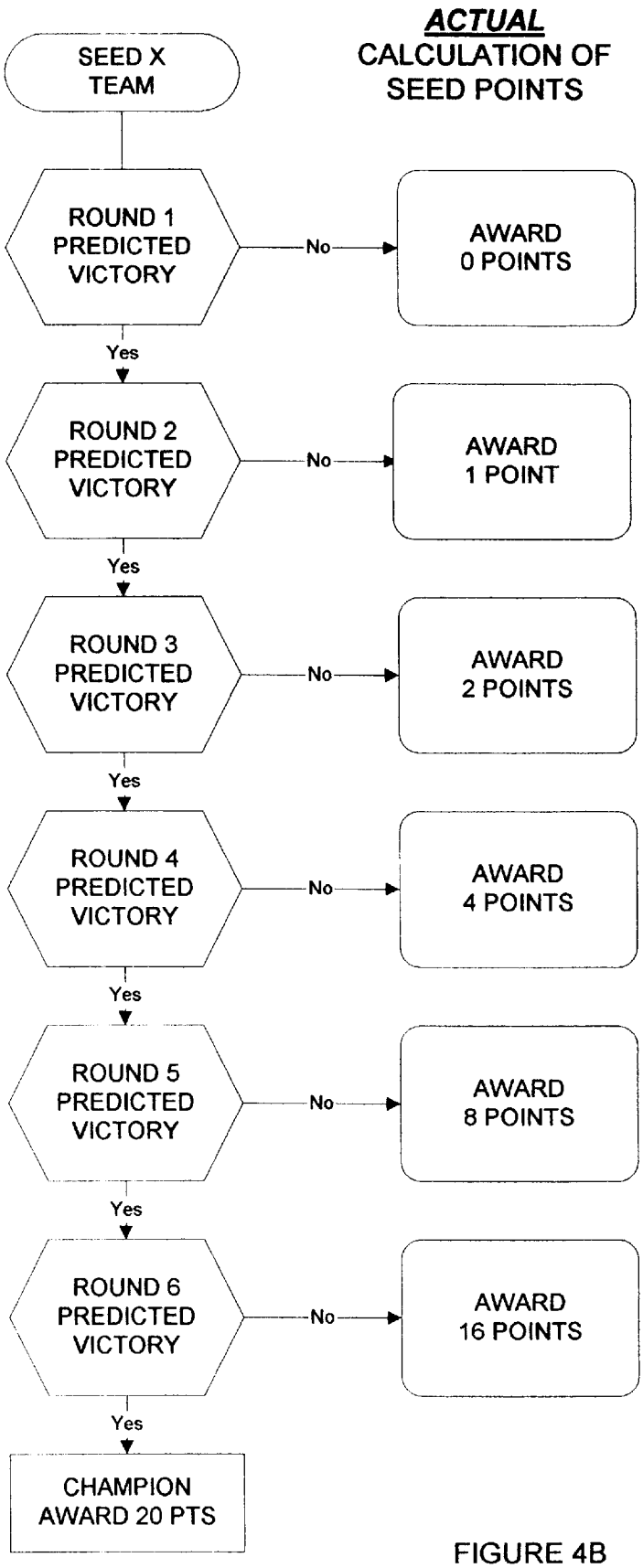

Just as contestant prediction points are predetermined by his slot selections prior to the start of the tournament, actual final point totals can only be assessed at the conclusion of the tournament. FIG. 4B shows a flowchart that can be used to assess actual game points awarded for each of the contestants 64 seed projections at the conclusion of the tournament. The flowchart shown in FIG. 4B is almost identical to the one shown in FIG. 4A with one important difference; FIG. 4A deals with predicted seed points, while 4B deals with actual seed points awarded.

FIG. 1B shows our ficticious contestant projecting seed S1 to proceed through and win the tournament. Likewise, FIG. 3 represents a ficticious tournament in which seed S1 proceeds through and wins the NCAA college basketball championship. Placing seed S1's championship pathway into the flowchart shown in FIG. 4B results in 20 actual points being awarded to team S1 at the tournaments conclusion. In a similar vain, the lowest seeded team S64 would be assessed zero actual points. This actual assignment is based on team S64's first round elimination as shown in FIG. 3.

Each contestant receives points for each of the tournaments 64 seeds based on either his pretourney projection, or the seeds actual tournament performance. Comparisons must be made between contestants predicted vs. tournament actual points assessments for each of the games 64 seeded teams. A contestant can not receive points for a seed which advances in the tournament beyond his upfront projection. Likewise, a contestant can receive less points than he originally projects for a seed if it upset in any round prior to the contestants projection. The lesser of these point totals, projected vs. Actual, are used for each of the contestants 64 seeds in determining his overall game score.

Figure 4C:
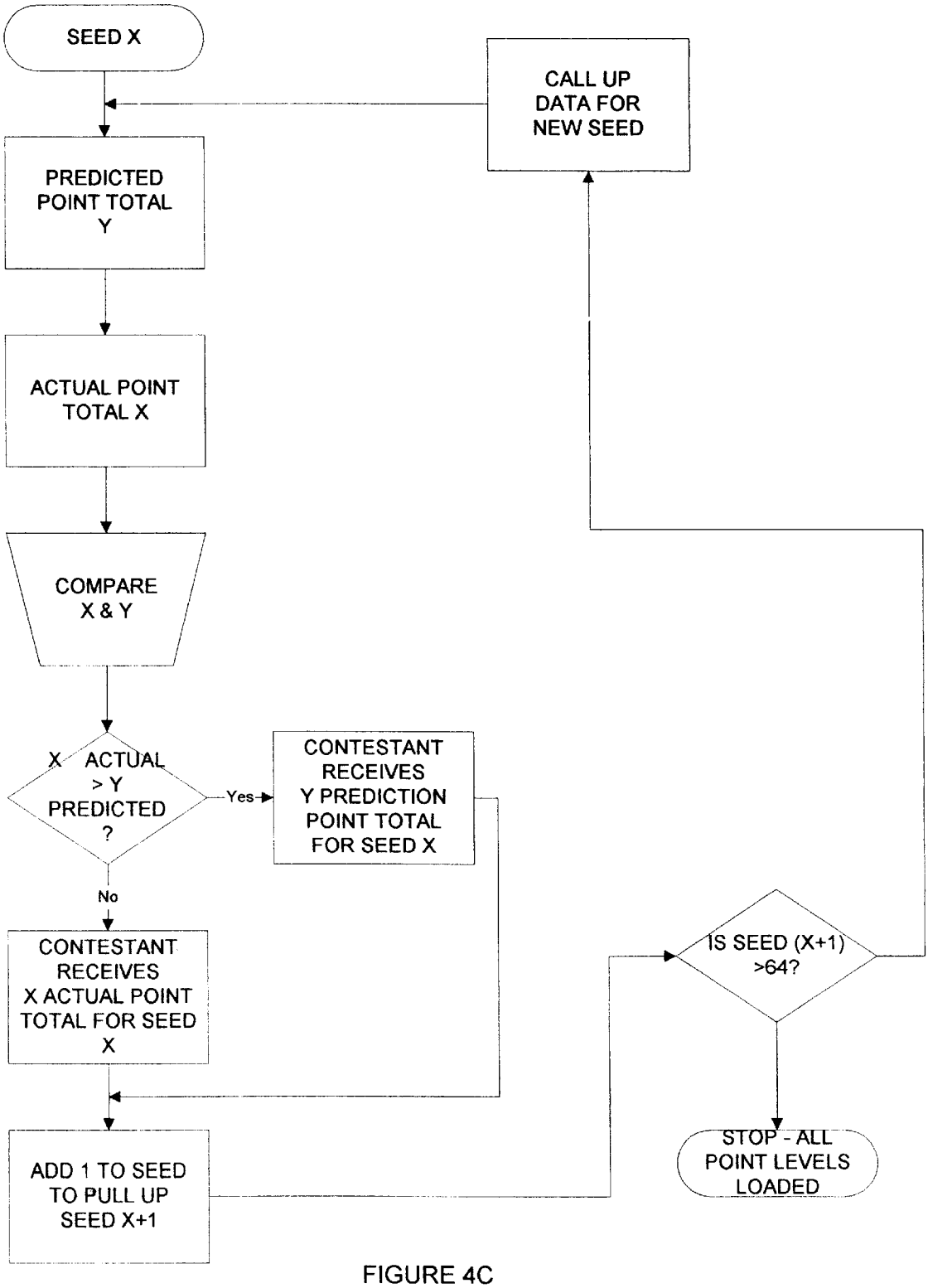

FIG. 4C shows a flowchart capable determining which of the 2 point totals, predicted or actual, are utilized for each of the 64 seeds in determining the contestants overall score. Utilizing top seed S1 as an example, 20 points were predicted by our contestant in FIG. 1B. According to FIG. 3 actual results, seed S1 indeed was the champion at the tournaments conclusion. Following the flowchart shown in FIG. 4C, 20 points are awarded to seed S1, as actual points do not exceed predicted points for our ficticious contestant.

FIG. 4C's flowchart might be more meaningfully explained by observing how game points are assessed for a team involved in a basketball tournament upset. According to FIG. 3, an upset occurs in round R4 of the NCAA tournament. Seed S2, a pretournament round R4 slot favorite, is defeated by seed S7. This victory, unanticipated by our contestant based on his FIG. 1B entrys, is indicated by upset U2 in FIG. 3. Thus seed S2 departs from the tournament early, while seed S7 advances beyond its projected finish and down the pathway established by the NCAA selection committee.

Actual point values awarded for individual seed performance depend on how many rounds the team under evaluation advances in the tournament. FIG. 2C's discontinuous 100 point awarding system is again employed to attach actual point values to our chosen example. By virtue of its early R4 round elimination, seed S2 receives 4 actual game points for its tournament performance. Seed S7, winner of upset U2, advances 1 additional round prior to its 5th round elimination as shown in FIG. 3. By virtue of making it into and eventually being eliminated in the semifinal round R5, seed S7 is awarded 8 actual points for its tournament efforts.

Game point totals for individual contestants involve comparing predicted points against actual points awarded for each of the tournaments 64 seeds. All game contestants are awarded either the predicted or actual points assigned to each of the 64 seeds. Our ficticious contestant predicted 6 points for seed S2, and 4 points for seed S7, based on the discontinuous point formula for round eliminations described in FIG. 4C. At the conclusion of our ficticious tournament, seed S2 receives only 4 points by virtue of its early departure resulting from upset U2. Seed S7, who advanced an additional round beyond our contestants projection, would be awarded 8 points for its tournament performance.

Following the flowchart shown in FIG. 4C, our ficticious contestant would receive the lesser of the actual vs. Predicted game points for seeds S2 and S7. In the case of seed S2, 16 points were predicted, while 4 points were assigned, resulting in the contestant being awarded 4 points (the lesser of the 2 point catagories). Seed S7, projected for 4 points at the start but awarded 8 points by virtue of its upset victory, results in 4 points awarded to our ficticious contestant. The flowchart shown in FIG. 4C is used to assess points for all 64 seeds in determining the overall point total for our ficticious game contestant. In this case, his inability to predict these upset slot victories has cost him valuable game points.

A large nationwide NCAA basketball prediction game pool, involving a significant number of dispersed contestants, requires the speed and memory available in modern data processing equipment. Each of the contestants 64 seeds can be tracked for each predicted game slot through the modern computer technology. Contestant vectors can be set up to keep track of wins and losses, predicted points vs. Actual points. These comparisons can take place on a round by round basis, realtime, keeping contestants fully abreast of their scores. Computer technology allows for simple comparisons of the 2 point columns, predicted vs. actual, for each of the 64 seeds through each round through the conclusion of the tournament.

FIG. 4D shows fields with this type of computerized data structure for tracking contestant results. The tournaments 64 basketball seeds are represented in rows. Round R1 through R6 victory and loss results, along with prediction and actual point assessments, are shown in the columns. The far right columns show points game contestant predicted PP, as well as actual points AP achieved by the various seeds. Per the flowchart shown in FIG. 4C, prediction game contestants receive the lesser of these point totals. As such, a special column CP, or contestant points, is set up in the overall contestant data structure. By totaling the contestant points CP column for all 64 seeds, an overall game score is determined.

Our ficticious candidate predicted the NCAA tournament would unfold exactly as the selection committee predicted, as shown by his FIG. 1B ballot. The ficticious tournament proceeded with just 2 upsets. U1 an U2, as shown in FIG. 3. These upsets unanticipated by our contestant, detracted from his overall point total. By adding up the contestant points CP in the column on the far right of FIG. 4D, a total of 82 points is arrived upon. Psychologically, a school score of 82 typically translated into a B grade.

Based on that standard, our ficticious candidate has done a good but not perfect job of predicting the NCAA tournament flow.

How does our ficticious candidates score of 82 compare against other contestants in predicting the NCAA tournament flow ? In a simple tournament, pencil and paper can be employed to place the contestants result in terms of score and overall rank. In a larger, nationwide tournament available across the internet, data processing equipment must be utilized to provide feedback to the contestant in terms of his tournament prediction results.

FIG. 5 shows an data processed output file of our ficticious tournament game. By employing a simple standard sorting method, such as a bubble sort, our contestant is ranked amongst amongst his peers. A score of 82 is considered good, placing him within the upper 20% of all contestants, according to this example. High ranking contestants may qualify for prizes should an accompanying wagering award structure exist for this level of prediction performance.

CONCLUSION, RAMIFICATIONS, AND SCOPE OF INVENTION

Thus the reader sees a NCAA basketball tournament prediction game that can be conducted nationwide, utilizes the advantages of a 100 point awarding system to determine contestant performance and rankings. This game system can provide contestants with real time feedback of scoring results through incorporation of data processing equipment and online web services.

While the above game description contains many specificities, these should not be construed as limitations on the scope of the invention, but rather as an exemplification of one preferred embodiment thereof. Many other variations are possible. For example. the 100 point awarding function of FIG. 4D could be employed, resulting in a different overall score for our contestants overall tournament flow prediction. A 500 point award system could be adapted for tournament game performance. Finally, other types of sporting events could be utilized in this type of 100 point prediction tournament game. Some sporting events that could be incorporated within the realm of this patent game include but are not lirmlited too; a) the World Cup soccer tournament, b) the NBA playoffs, c) the NFL playoffs, d) Major League baseball playoffs, amongst others.

Accordingly, the scope of the invention should be determined not by the embodiment(s) illustrated, but by the appended claims and their legal equivalents.

I claim:

1. A sports tournament scoring method comprising:

obtaining a contestant entry form featuring a binary multiple of teams numbering at least eight teams arranged in a single elimination tournament format with a game slot for each victorious team in a prior round, the pairing of the teams for a first round competition by a selection committee;

making, by a contestant, victory predictions and entering those victory predictions into the tournament game slots of the entry form for the contestant;

assigning a point value for each correct victory prediction, said point value assigning step carried out so the overall maximum number of points is 100, the minimum number of points is zero and the overall point value for each round being different from at least one other round;

determining whether the victory prediction for each said game slot is a correct or an incorrect victory prediction; and calculating the total points for the contestant based upon the number of correct victory predictions.

2. The scoring method according to claim 1 further comprising notifying the contestant of tournament results.

3. The scoring method according to claim 2 wherein the notifying step comprises comparing the total points based on the victory predictions of a contestant against the total points based on the victory predictions of a selection committee.

4. The scoring method according to claim 1 wherein the obtaining step is carried out with the number of teams equaling 64.

5. The scoring method according to claim 1 further comprising ranking means for ranking how well a contestant's total points compares with the total points for a group of contestants.

6. A sports tournament scoring method comprising:

pairing of $2^n$ teams in a single elimination tournament fornat with a game slot for each victorious team in a prior round, where n is an integer of at least 3;

entering victory predictions into the game slots;

assigning a point value for each correct victory prediction, said point value assigning step carried out so the overall maximum number of points is 100, the minimum number of points is zero and the point value for each round being different from at least one other round;

determining whether the victory prediction for each said game slot is a correct or an incorrect victory prediction; and calculating the total points based upon the number of correct victory predictions.

7. The scoring method according to claim 6 further comprising ranking means for ranking how well a contestant's total points compares with the total points for a group of contestants.

* * * * *